US006826831B2

(12) United States Patent
Crawley

(10) Patent No.: US 6,826,831 B2
(45) Date of Patent: Dec. 7, 2004

(54) METHOD FOR SERVICING TELECOMMUNICATION BOX

(76) Inventor: Timothy M. Crawley, 5822 W. Purdue Ave., Glendale, AZ (US) 85302

( * ) Notice: Subject to any disclaimer, the term of this patent is extended or adjusted under 35 U.S.C. 154(b) by 77 days.

(21) Appl. No.: 10/116,513

(22) Filed: Apr. 3, 2002

(65) Prior Publication Data

US 2003/0188609 A1 Oct. 9, 2003

(51) Int. Cl.[7] ..... H01R 43/04

(52) U.S. Cl. ..... 29/861; 29/865; 29/897.32; 7/107; 72/409.14; 81/438

(58) Field of Search ..... 29/861–867, 897.2, 29/897.3, 897.32; 7/107, 127, 129; 72/405.12, 409.14, 409.16, 409.19; 81/177.4, 438–440, 490; 140/105, 106

(56) References Cited

U.S. PATENT DOCUMENTS 3,947,905 A * 4/1976 Neff ..... 7/107
4,448,097 A * 5/1984 Rocca ..... 81/177.4
5,450,775 A * 9/1995 Kozak ..... 81/440
5,904,080 A * 5/1999 Anderson et al. ..... 81/439

* cited by examiner

*Primary Examiner*—Peter Vo
*Assistant Examiner*—Donghai D. Nguyen
(74) *Attorney, Agent, or Firm*—Tod R. Nissle, P.C.

(57) ABSTRACT

A method is provided for servicing a telecommunication junction box. The method enables a reduced number of tools to be utilized to service a telecommunication junction box.

1 Claim, 10 Drawing Sheets

FIG. 1: PRIOR ART

FIG. 2: PRIOR ART

FIG. 3
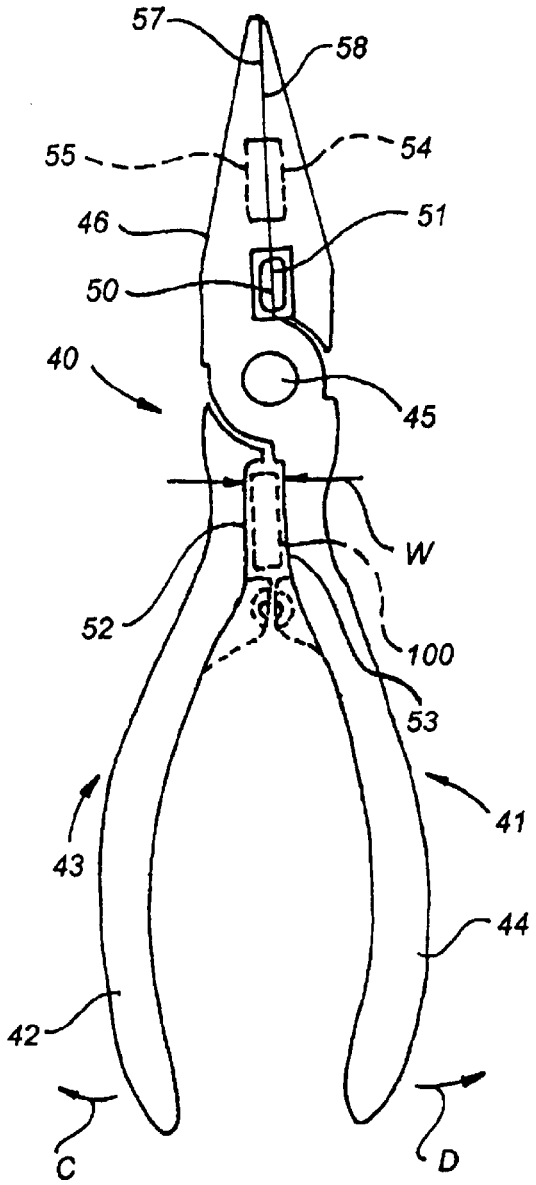
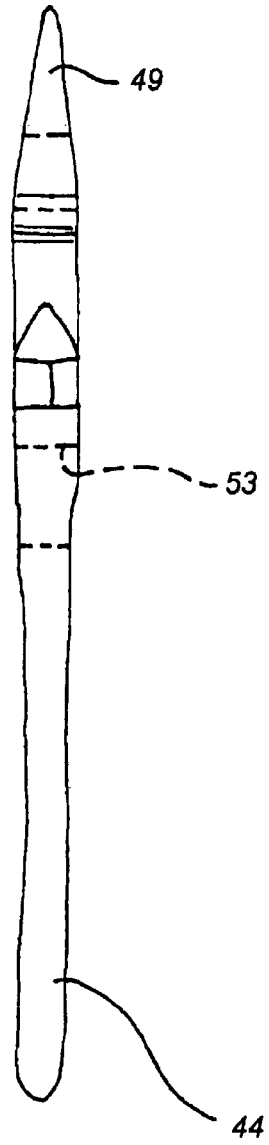
FIG. 4

FIG. 7: PRIOR ART
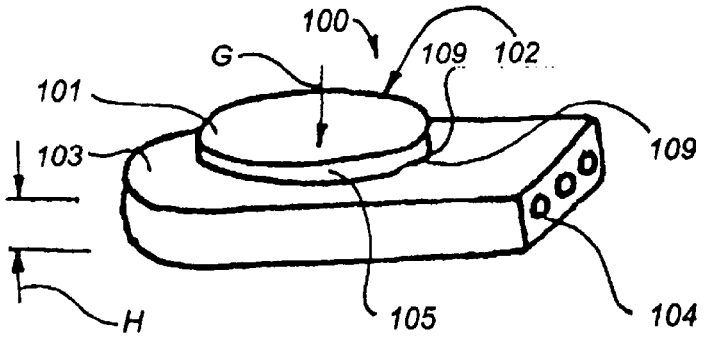
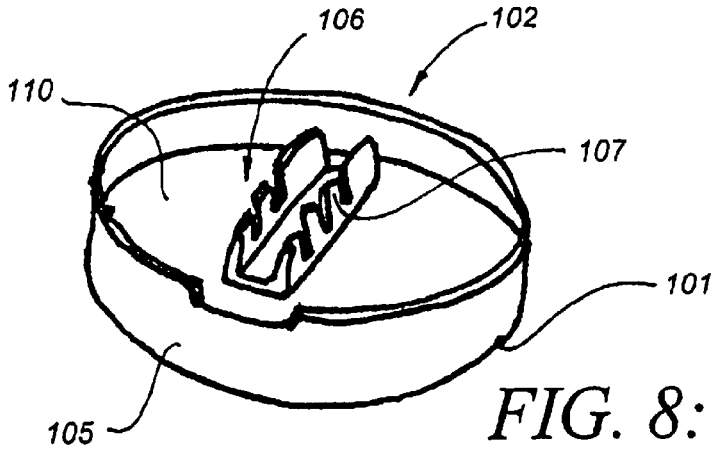
FIG. 8: PRIOR ART

FIG. 9: PRIOR ART
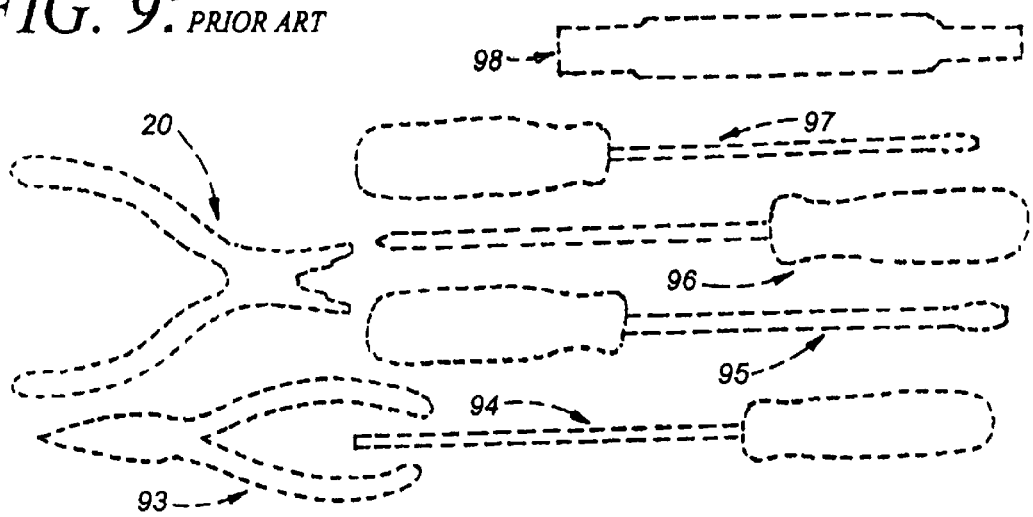
FIG. 10
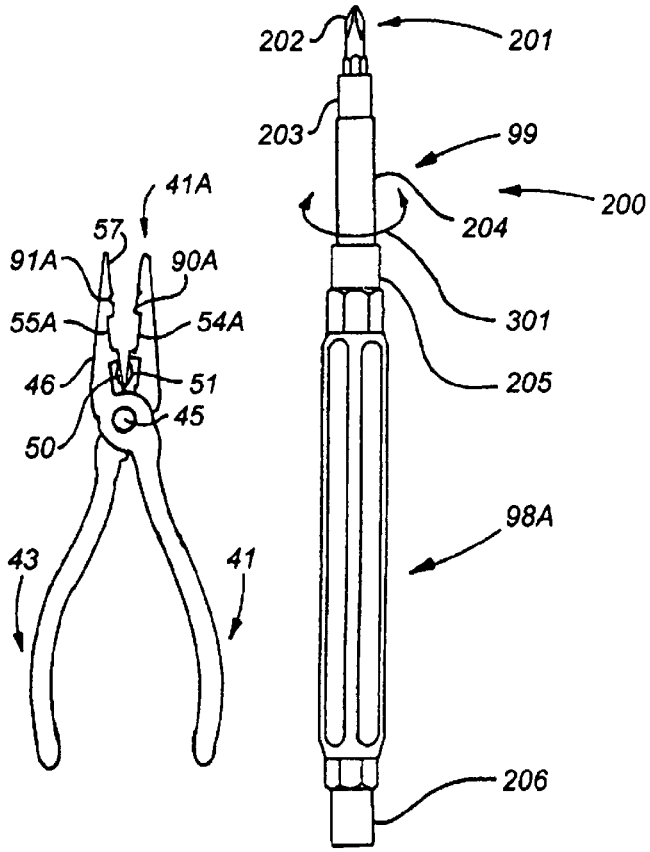

FIG. 14
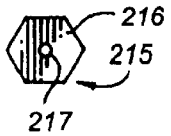
FIG. 15
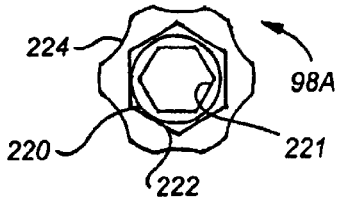
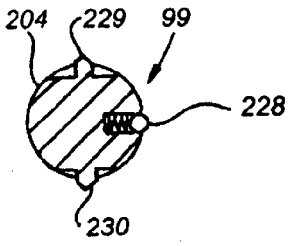
FIG. 16
FIG. 17
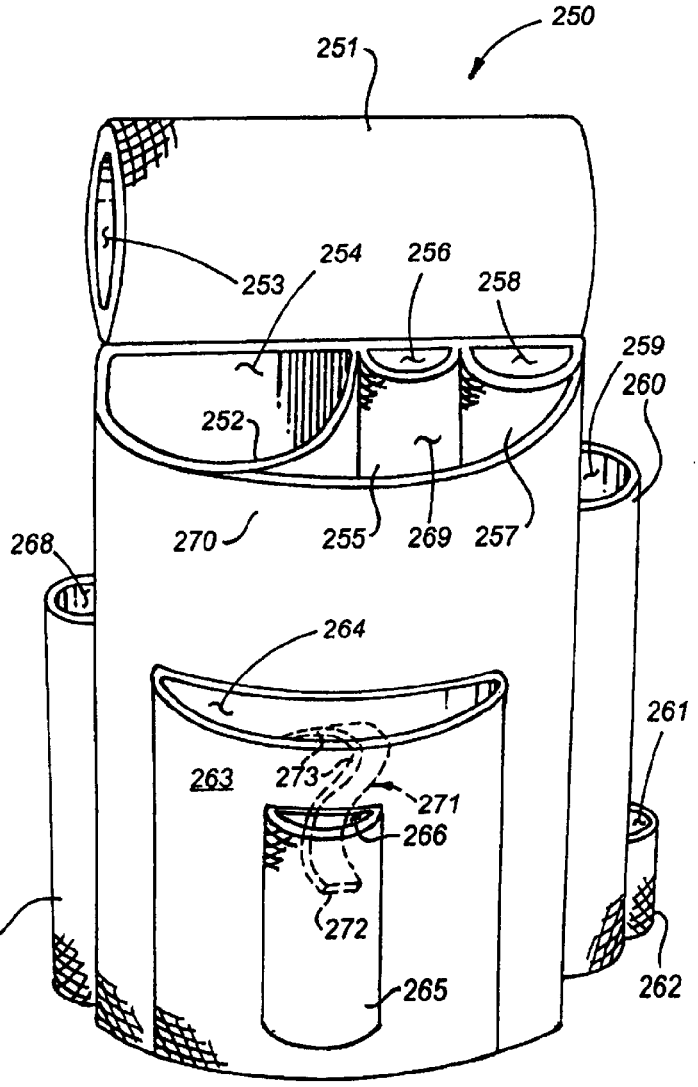

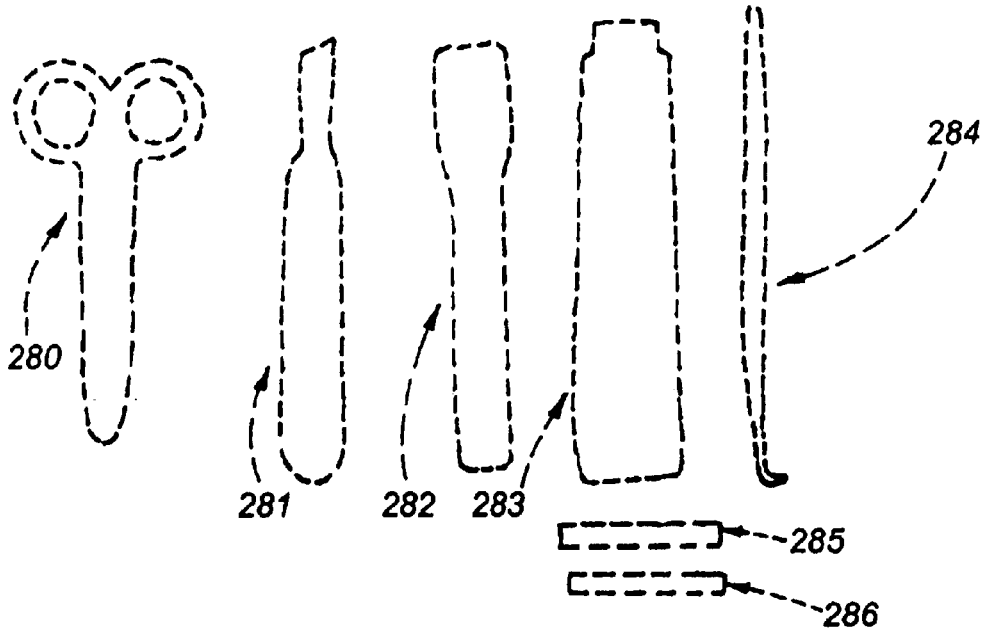
FIG. 18: PRIOR ART
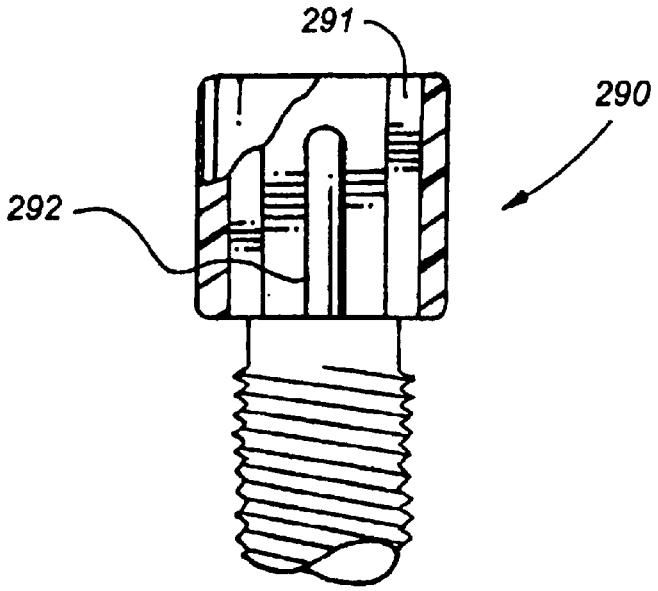
FIG. 19: PRIOR ART

METHOD FOR SERVICING TELECOMMUNICATION BOX

This invention relates to methods and apparatus for servicing a telecommunication junction box having a plurality of fasteners, wires and electrical connections.

More particularly, the invention relates to a method and apparatus for accessing and crimping a wire in a telecommunications junction box.

Telephone systems in the United States and other countries entail the use of relatively complex wiring. Telecommunication housings or junction boxes which contain many strands of telephone wires are placed in cities, towns and suburbs throughout the United States. Telephone company technicians open these junction boxes and connect, disconnect, crimp, and otherwise manipulate the wire housed in the boxes. Each wire typically includes an electrically insulative coating except at points along the wire which are stripped to expose the bare metal wire.

Telecommunication junction boxes have a variety of names, including cross box, ready access point, pedestal, SNI (standard network interface box on the sides of homes), and demarcation point (typically in large buildings). Wires in the junction boxes typically are attached to binding posts, punch down blocks, screw terminals, or other electric terminals.

A large incoming feeder line with fifty pairs of wires connects to the pedestal. A plurality of smaller outgoing buried service lines extend from the pedestal to a plurality of homes or other building structures. Each buried service wire includes in its center two to six pairs of wires. Each pair of wires serves as one telephone line. A buried service wire extends from a pedestal to the SNI in a telecommunications box. The SNI (standard network interface) is the demarcation point at which telephone company service lines end and connect to telephone lines or wiring in a home or other building structure.

The two to six pairs of wire in each buried service wire are surrounded by a rubber insulator. The rubber insulator is surround by a layer or jacket of wound copper. The jacket further protects the two to six pairs of wire and serves as an electrical ground. Another layer of insulation is formed over the copper jacket to protect the copper. At times, it is necessary for a telephone repairman to cut through the layer of insulation formed over the copper jacket.

When a telephone company technician is accessing through a junction box door 17 a wire 15 in the junction box 16, he can use the tool 10 illustrated in FIG. 1. Tool 10 includes handle 13 and neck 11 pivotally attached to handle 13 by pin 12. The distal end of handle 11 includes hook 14. The technician uses hook 14 to engage wire 15 and pull wire 15 free from a bundle or group of other wires in box 16. Hook 14 may be utilized to pull a second wire (third wire, etc.) out from a bundle or group of wires. A wire cutter can be utilized to cut the wire 15 in half, if desired.

A "button" 100 (FIGS. 7 and 8) can be utilized to crimp or "splice" together two or more wires. Button 100 includes a cylindrical opening 109 which slidably receives cylindrical member 102. U-shaped metal member 106 includes rows of electrically conductive metal teeth 107. Member 106 is fixedly attached to inner surface 110 of member 102. Member 106 includes outer cylindrical wall 105 and circular upper surface 101. When surface 101 is depressed in the direction of arrow G, member 102 slides into cylindrical opening 109. If wire ends have been slidably inserted through cylindrical openings 104 so that the ends are positioned under member 102, then when member 102 is pressed into opening 109, teeth 107 penetrate the insulation covering the wire ends and contact and electrically interconnect the wires. A variety of crimping or splicing buttons are known in the art. By way of example, 3M Company produces various SKOTCHLOK (TM) connectors which are used to splice together wires without having to strip off and remove the insulation from the wires at the points at which the wires are being spliced.

The tool 20 shown in FIG. 2 is typically used to squeeze, or crimp, member 102 after button 100 is inserted between gripping members 26 and 29 and handles 22 and 24 are manually displaced about pivot point 25 in the direction of arrows J and K to displace members 26 and 29 in the direction of arrows L and M to force member 102 in the direction of arrow G into opening 109 in housing 103. Button 100 rests against and is contacted by support surface 27, 30 and 31 when handles 22, 24 are manually displaced in the direction of arrows J and K to force member 102 into housing 103.

The foregoing procedure for manipulating wire in a telecommunication junction box has been used many times by telephone technicians. One disadvantage of the procedure is that it requires one tool 10 to remove a wire, requires another tool to cut the wire, and requires yet another tool 20 to crimp button 100 on a wire or wires. This requires a telephone technician to pick up, manipulate, and put down several tools while attempting to manually hold on to and manipulate one or more wires, a plurality of tools, and a crimping or splicing button 100. It would be highly desirable to provide an improved method and apparatus for crimping or splicing wires.

In addition to crimping tool 20, other tools typically carried by a telephone technician are illustrated in FIGS. 9 and 18 and include needle nose pliers 93, can wrench 98, a screwdriver 97 with a small flat head, a screwdriver 95 with a large flathead, a sni tool 94, a Phillips screwdriver 96 with a "star" head, a pair of scissors 280, a sheath or cable knife 281, a flashlight 282, a punch down 283, bits 285 and 286 utilized in punchdown 283, a wire pick 284, and a can of dog spray (not shown).

A bolt 290 (FIG. 19) is used to open and close access doors in a telecommunication junction box. The head of the bolt includes an aperture with an internal hex surface 291 and a dimple 292 formed in the bottom of the aperture. A sni tool 94 is used to engage and turn bolt 290. The sni tool 94 includes an external hex surface shaped to conform to and be slidably inserted in hex surface 291. The distal tip of tool 93 includes a detent 217 (FIG. 14) shaped and dimensioned to conform to and fit over dimple 292.

The can wrench 98 is equivalent to member 98A, except that member 98A includes a hollow or opening 227 extending far into member 98A. In a conventional can wrench 98, the opening 227 is dimensioned to extend into wrench 98 only about as far as opening 223 in wrench 98A. A conventional can wrench is operated by a telecommunication technician only by utilizing internal hex surfaces shaped like surfaces 221 and 226 to loosen and tighten hex nuts.

It would be highly desirable to reduce and simplify the tool kit carried by a telecommunication technician to service a telecommunication junction box.

Therefore, it is a principal object of the instant invention to provide an improved method and apparatus for servicing a telecommunication junction box.

These, and other and further and more specific objects of the invention, will be apparent to those skilled in the art based on the following description, taken in conjunction with the drawings, in which:

FIG. 3 is a front elevation view illustrating a tool constructed in accordance with the invention;

FIG. 4 is a side elevation view further illustrating the tool of FIG. 3;

FIG. 7 is a perspective view illustrating a button used to crimp or splice wires;

FIG. 8 is a perspective view illustrating a component of the button of FIG. 7;

FIG. 9 is a top view illustrating in ghost outline some of the tools ordinarily carried by a telecommunication technician to service a telecommunication junction box;

FIG. 10 is a top view illustrating a pair of tools which perform the function of and replace the tools of FIG. 9;

FIG. 14 is an end view illustrating the sni tool portion of the bit of FIG. 13;

FIG. 15 is an end view further illustrating the tool of FIG. 11;

FIG. 16 is a cross sectional view of the tool of FIG. 11 takes along section lines 16—16 thereof and further illustrating construction details thereof;

FIG. 17 is a perspective view of a pouch shaped and dimensioned to carry the tools of FIGS. 10 and 18, along with a can of dog spray;

FIG. 18 is a top view illustrating in ghost outline other tools commonly carried by a telecommunication technician; and, FIG. 19 is a side partial section view illustrating a bolt utilized to open and close doors in a telecommunications junction box.

Figure 1:
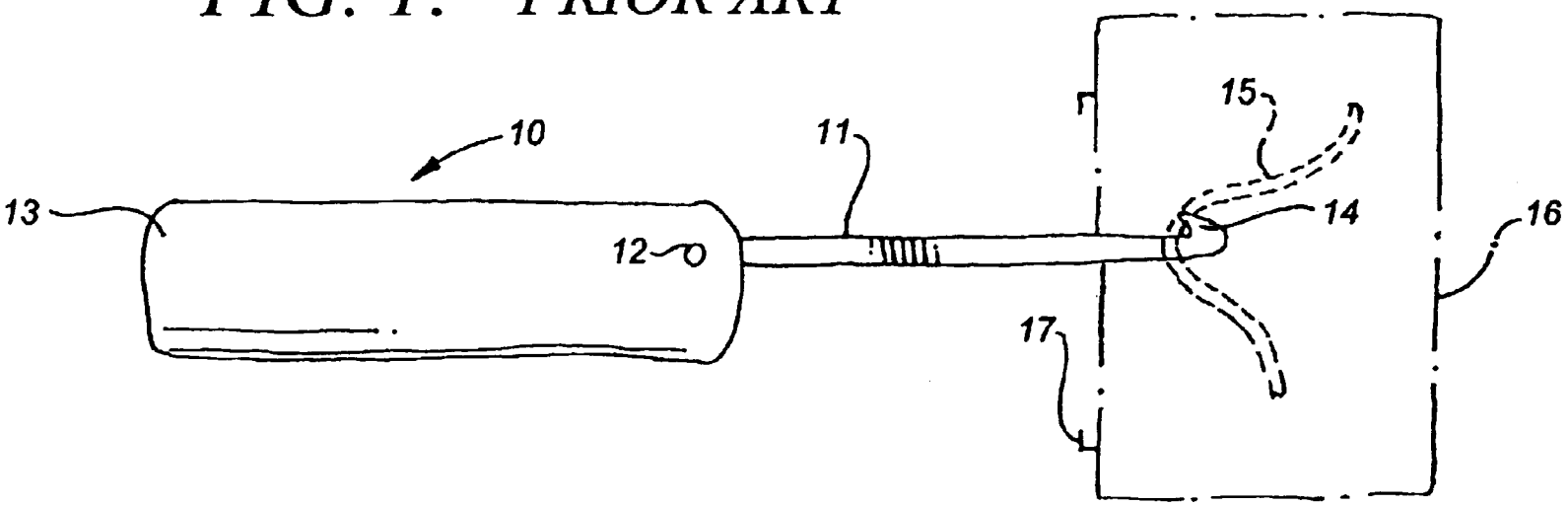
FIG. 1 is a side view illustrating a prior art tool for engaging and moving a wire in a telecommunication junction box.
Figure 2:
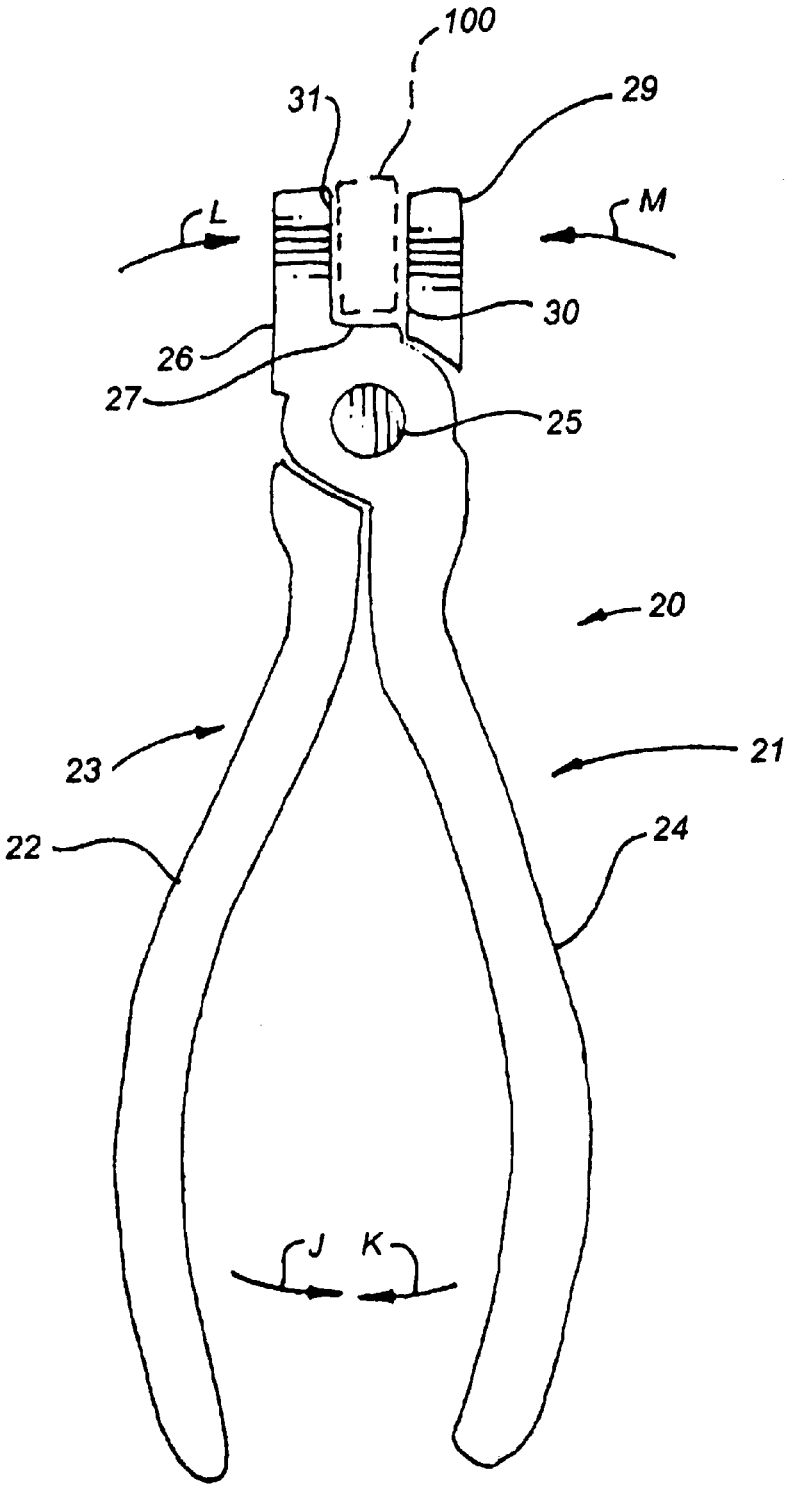
FIG. 2 is a front elevation view illustrating a prior art tool for compressing a button used to splice or crimp wires.

Briefly, in accordance with the invention, I provide an improved method of crimping a wire in a telecommunication junction box. The telecommunication junction box includes a door; a plurality of electrical connectors; and, a plurality of wires each connected to at least one electrical connector. The improved method includes the steps of providing a crimping button; and, providing a manually operated tool including a pair of components that are pivotally connected. Each component includes a handle at the distal end operatively opposed to the handle at the distal end of the other one of the pair of components; a needle nose gripping member at the proximate end operatively opposed to the needle nose gripping member at the proximate end of the other one of the pair of components; and, at least one crimp space formed therein. The method also includes the steps of opening the door to the telecommunication box; manually manipulating the tool to grasp a portion of at least one of the wires with the needle nose gripping members and displace the portion; placing a crimping button on the portion of the wire; and, manually manipulating the tool to grasp the crimping button in the crimp space of the tool and to compress the crimping button in the crimp space.

In another embodiment of the invention, I provide an improved tool including a pair of components pivotally connected. Each pair of components includes a handle at the distal end operatively opposed to the handle at the distal end of the other one of the pair of components; a needle nose gripping member at the proximate end operatively opposed to the needle nose gripping member at the proximate end of the other one of the pair of components; and, a cutting edge operatively opposed to the cutting edge on the other one of the pair of components. The tool also includes at least one crimp space formed therein shaped and dimensioned to receive and compress a crimp button.

In a further embodiment of the invention, I provide an improved method of servicing a telecommunication box. The box includes at least one door; a nut with an external hex surface; a bolt with an internal hex surface and a dimple and mounted in the door to open and close the door; a plurality of electrical connectors; and, a plurality of wires each connected to at least one electrical connector. The method includes the step of providing a crimping button including a housing; an opening formed in the housing; a member mounted in the housing in a first operative position and displaceable to a second operative position; and, an electrically conductive strip attached to the member to contact at least one wire in the housing when the member is displaced to the second operative position. The method also includes the step of providing a first manually operated tool including a pair of components pivotally connected and each including a distal end and a proximate end; a handle at the distal end operatively opposed to the handle at the distal end of the other one of the pair of components; and, a needle nose gripping member at the proximate end operatively opposed to the needle nose gripping member at the proximate end of the other one of the pair of components. The tool also includes at least one crimp space formed therein. The method also includes the step of providing a second manually operated tool including a handle including a first end and a second end; an opening formed in the first end and including an internal hex surface shaped to slide over and engage the nut; a sleeve including a first end and a second end each shaped and dimension to slide into the opening, the second end extending into the opening; an aperture formed in the first end of the sleeve; and, a bit. The bit includes a collar shaped and dimensioned to be slidably inserted in the aperture in the first end of the sleeve and including a first side and a second side; a first sni tool end connected to and outwardly extending from the first side of the collar and shaped and dimensioned to extend into the aperture, the sni tool end extending into the aperture; and, a second tool end connected to and outwardly extending from the second side of the collar and shaped and dimensioned to extend into the aperture. The method also includes the steps of removing the sleeve from the opening; removing the bit from the aperture in the first end of the sleeve; utilizing the sni tool to open the door to the telecommunication box; manually manipulating the tool to reach into the telecommunication box and grasp a portion of at least one of the wires with the needle nose gripping members and displace the portion to a desired location; placing a crimping button on the portion of the wire; and, manually manipulating the tool to grasp the crimping button in the crimp space of the tool and to compress the crimping button in the crimp space to move the member from the first to the second operative position.

In still another embodiment of the invention, I provide an improved tool for servicing a telecommunications box. The telecommunications box includes at least one door; a nut with an external hex surface; a bolt with an internal hex surface and a dimple and mounted in the door to open and close the door; a plurality of electrical connectors; and, a plurality of wires each connected to at least one electrical connector. The tool includes a handle including a first end and a second end; an opening formed in the first end and including an internal hex surface shaped to slide over and engage the nut; and, a sleeve including a first end and a second end each shaped and dimension to slide into the opening. The second end extends into the opening. The tool also includes an aperture formed in the first end of the sleeve; and, a bit. The bit includes a collar shaped and dimensioned to be slidably inserted in the aperture in the first end of the sleeve. The collar also includes a first side and a second side. The bit includes a first sni tool end connected to and outwardly extending from the first side of the collar and shaped and dimensioned to extend into the aperture. The sni tool end extends into said aperture. The bit also includes a second tool end connected to and outwardly extending from the second side of the collar and shaped and dimensioned to extend into the aperture.

Figure 5:
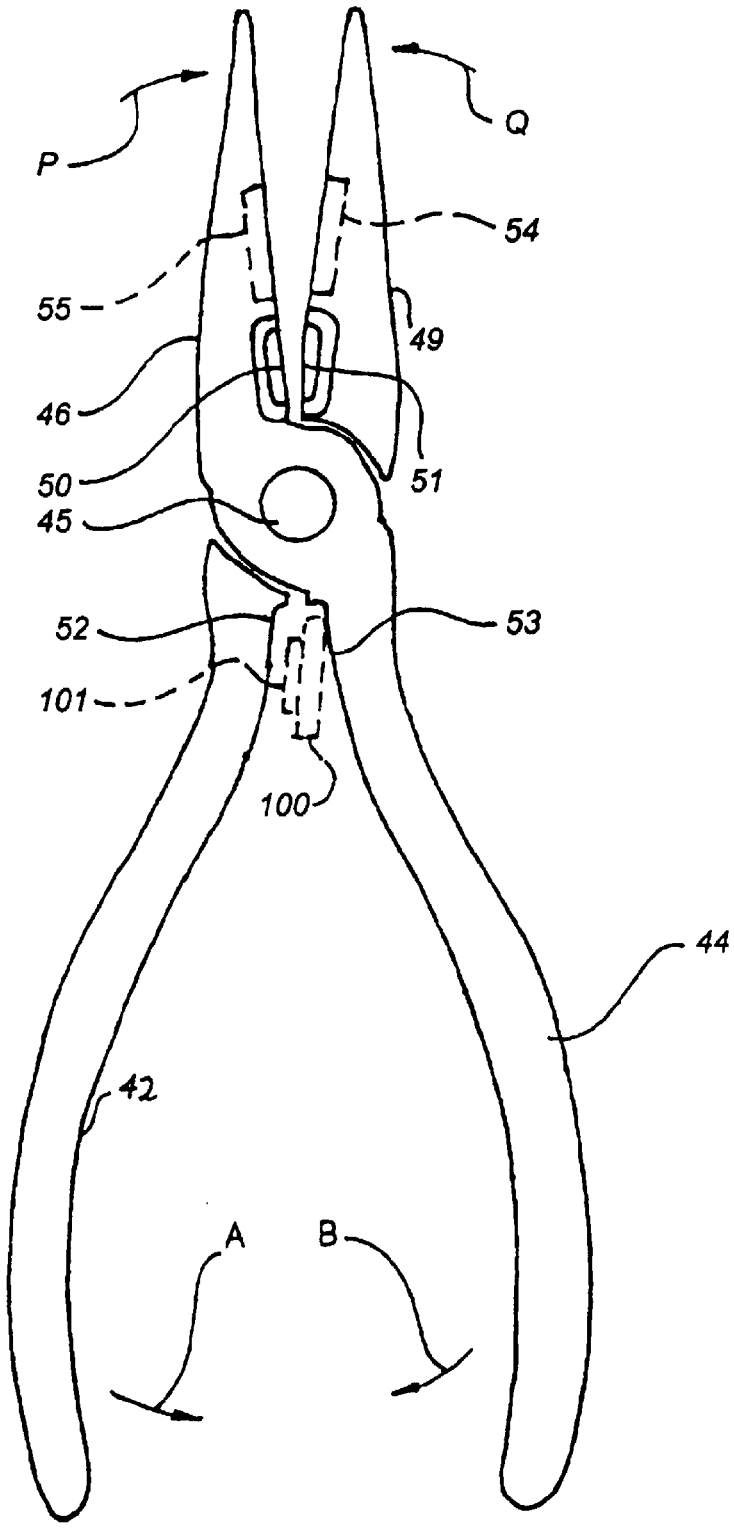
FIG. 5 is a front elevation view illustrating the mode of operation of the tool of the invention.
Figure 6:
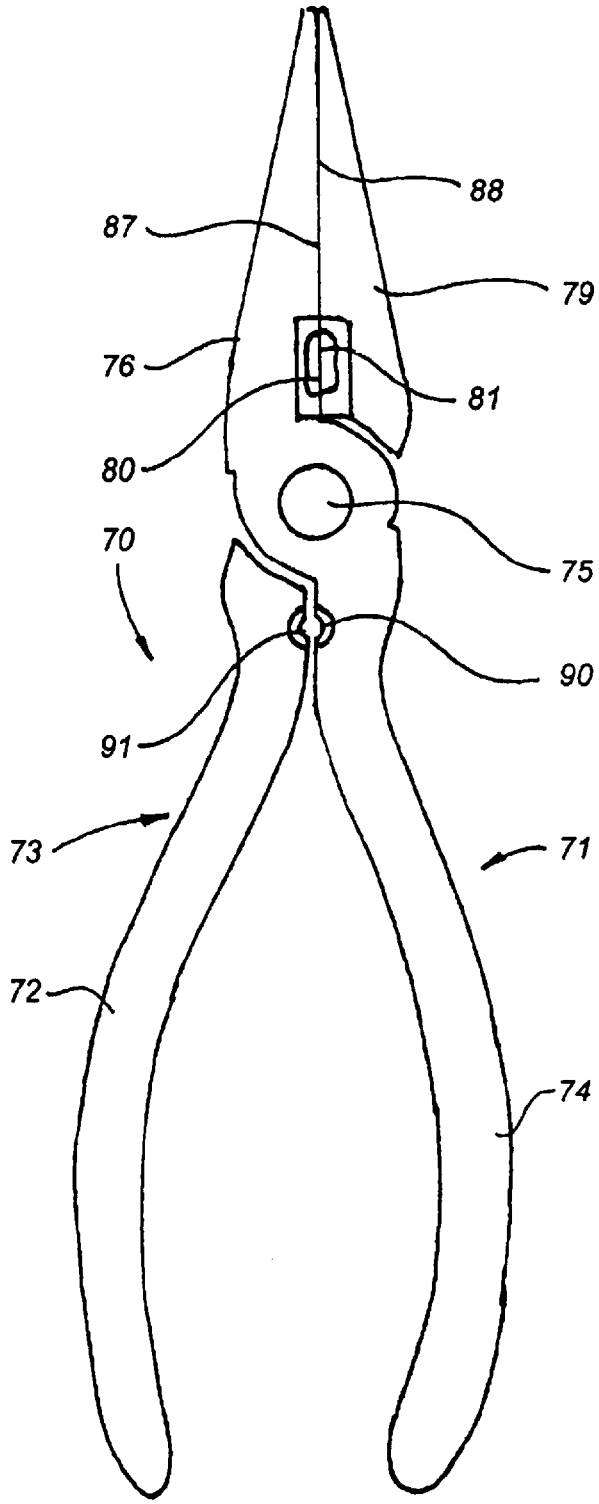
FIG. 6 is a front elevation view illustrating an alternate embodiment of the invention.

Turning now to the drawings, which describe the presently preferred embodiments of the invention for the purpose of describing the operation and use thereof and not by way of limitation of the scope of the invention, and in which like reference characters refer to corresponding elements throughout the several views, FIGS. 3 to 5 illustrate a tool 40 constructed in accordance with the principles of the invention and including gripping needle-nose members 46 and 49 and handles 42 and 44. Handles 42 and 44 are manually displaced about pivot point 45 in the direction of arrows A and B to displace members 46 and 49 in the direction of arrows P and Q to force member 102 in the direction of arrow G into cylindrical opening 109 in housing 103 when button 100 is placed between support surfaces 52 and 53 in handles 42 and 44. The distance W between support surfaces 52 and 53, when members 41 and 43 are in the closed position of FIG. 3, is about equal to the width or height H (FIG. 7) of housing 103. As shown in FIG. 7, member 102 extends outwardly from housing 103 prior to button 100 being crimped. When button 100 is crimped, member 102 is driven into housing 103 in the direction of arrow G.

Needle nose members 46, 49 include gripping surfaces 57, 58 which typically, although not necessarily, are serrated. Member 41 includes member 46 and handle 44. Member 43 includes member 49 and handle 42.

A cutting edge 50, 51 is formed in each of members 46, 49. When members 46,49 are closed as illustrated in FIG. 3, edges 50, 51 oppose and contact one another. Edges 50 and 51 are used to cut a piece of wire by placing the wire between edges 50, 51 when members 46 and 49 are opened to the position shown in FIG. 5 and by then manually pressing handles 42 and 44 in the direction of arrows A and B to squeeze edges 50, 51 through the wire to cut the wire into two pieces.

If desired, an orthogonal opening for crimping a button 100 can be formed in members 46 and 49 at the location indicated by dashed lines 54, 55 by cutting out the portions of members 46 and 49 circumscribed by dashed lines 54, 55. The crimping opening circumscribed by dashed lines 54, 55 would, when tool 40 was in the closed position illustrated in FIG. 3, have a shape and dimension comparable to that of the orthogonal opening which is formed in handles 42 and 44 and which includes opposing flat surfaces 52, 53. Surface 52 and 53 are generally parallel when handles 42 and 44 are in the closed position depicted in FIG. 3. The opening circumscribed by dashed lines 54, 55 would include opposing flat surfaces 52A, 53A. Surfaces 52A and 53A would preferably, but not necessarily, be generally parallel when handles 42 and 44 are in the position illustrated in FIG. 3.

Since the function of the crimping opening is, when a button 100 is positioned in the opening, to compress member 102 in the direction of arrow G, it is understood that the shape and dimension of the crimping opening can vary as long as the surfaces function to compress member 102, i.e. surfaces 52 and 53 need not necessarily be flat or be substantially parallel when handles 42 and 44 are in the closed position. Tool 70 includes gripping needle-nose members 76 and 79 with gripping surfaces 87 and 88, and handles 72 and 74. Handles 72 and 74 are manually displaced about pivot point 75 to displace members 76 and 79. Opposing cutting edges 80 and 81 are formed in members 76, 79, respectively. Semicircular edges 90 and 91 are formed in handles 74 and 72, respectively, and are used to strip insulation from wire. Pivotally connected members 71 and 73 each include a member—handle pair. Member 71 includes member 76 and handle 74. Member 73 includes member 79 and handle 72.

The tool 41A in FIG. 10 is identical to tool 41 except that opposing orthogonal crimping openings 55A, 54A are formed in nose members 46 and 49, respectively, and opposing semi-circular wire stripping apertures 91A and 90A are formed in nose members 46 and 49, respectively Tool 200 includes includes member 98A and unit 99. Unit 99 is, as will be described, shaped and dimensioned to be removably inserted in member 98A. Member 98A includes a first end including external 9/16 inc wide hex surface 22, surface 206, and an aperture 223 extending into member 98A. The upper or outer end of aperture 223 includes internal 3/8 inch wide hex surface 221. Surface 221 is slightly wider than the remaining portion of aperture 223 which extends into member 98A, producing neck or ledge 223A.

Member 98A includes a second end including external 5/8 inch wide hex surface 225, surface 205, and an aperture 227 extending into member 98A. The upper or outer end of aperture 227 includes internal 7/16 inch wide hex surface 226. Surface 226 is slightly wider than the remaining portion of aperture 227 that extends into member 98A, producing neck or ledge 227A.

Figure 11:
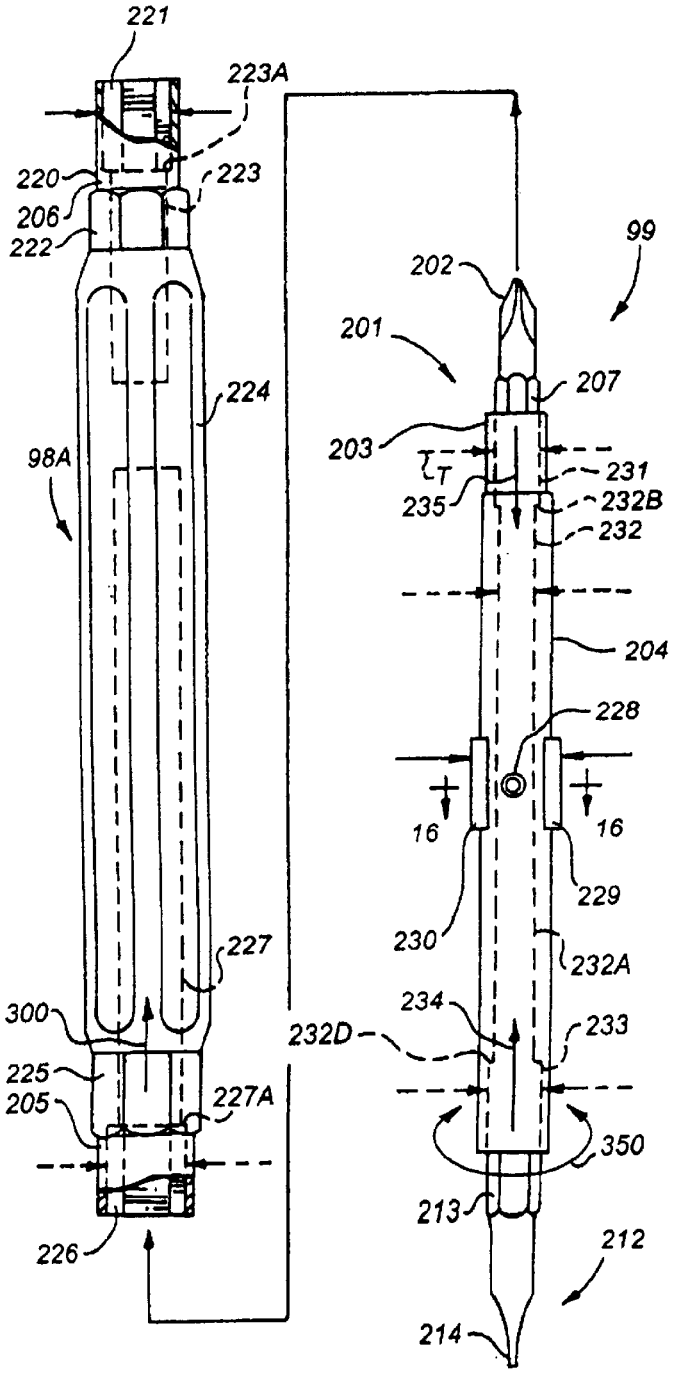
FIG. 11 is a top assembly view further illustrating one of the tools of FIG. 10.

Unit 99 is slidably removably mounted in member 98A by slidably inserting either end of unit 99 into aperture 227. Unit 99 can be inserted in aperture 227 without bits 201 or 212 inserted in hollow barrel 204. The central area of barrel 204 is shaped and dimensioned to engage hex surface 226 such that barrel 204 will not rotate in the directions indicated by arrows 350 (FIG. 11) after barrel 204 is inserted in member 98A to a position like that illustrated in FIG. 10, and such that the central area of barrel 204 abuts ledge 227A and cannot be pressed past ledge 227A in the direction of arrow 300 into aperture 227. As illustrated in FIGS. 11 and 16, the central area of barrel 204 includes tips 229, 230 that each extend outwardly past the cylindrical outer surface of barrel 204. When barrel 204 is slidably inserted in aperture 227 in the direction of arrow 300, tips 229, 230 each contact ledge 227A and halt the travel of barrel 204 in the direction of arrow 300. Tips 229 and 230 also engage internal hex surface 226 and prevent the rotation of barrel 204 in member 98A in the directions indicated by arrows 301 in FIG. 10 and by arrows 350 in FIG. 11. When barrel 204 is slidably inserted in member 98A (with or without bits 201 and 212 inserted in barrel 204), spring-loaded ball bearing 228 presses against surface 226 to help maintain barrel 204 in position in aperture 227. Barrel 204 includes apertures 232 and 232A and end 203. The upper or outer end 231 of aperture 232 includes an internal approximately 1/4 inch wide hex surface. This hex surface is slightly wider than the remaining portion of aperture 232, producing neck or ledge 232B. The upper end 233 of aperture 232A includes an internal approximately 5/16 wide hex surface. This hex surface is slightly wider than the remaining portion of aperture 232A, producing neck or ledge 232D.

Bit 201 includes Phillips tip 202, small flat head screwdriver tip 209, external hex surface 207 having a width indicated by arrows Y and shaped to slidably insert into the hex surface formed in end 231, and spring loaded ball bearing 208 that bears against the hex surface in end 231 when bit 201 is inserted in barrel 204 to the position illustrated in FIGS. 10 and 11.

Bit 212 includes sni tool 215 with tip 216, large flat head screwdriver tip 214, external hex surface 213 having a width indicated by arrows 211 and shaped to slidably insert into the hex surface formed in end 233, and spring loaded ball bearing 215A that bears against the hex surface formed in end 233 when bit 212 is inserted in barrel 204 to the position illustrated in FIG. 11.

Figure 12:
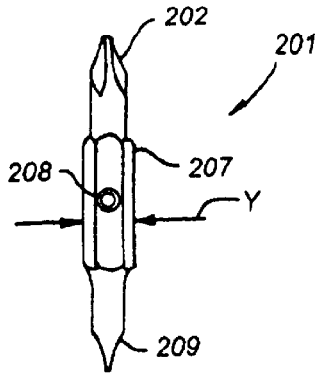
FIG. 12 is a top view illustrating a bit utilized in the tool of FIG. 11.

Bit 201 can be inverted and inserted in aperture 232 such that tip 209 is visible and tip 202 is inside aperture 232. When bit 201 is inserted in aperture 232 in the direction of arrow 235, hex surface 207 contacts ledge 232B to halt the travel of bit 201 in the direction of arrow 235 such that bit 201 is seated in aperture 232 with tip 202 in the position shown in FIG. 11 (or with tip 209 in a comparable position in the event bit 201 is inverted from the position shown in FIG. 12 and is inserted in aperture 232).

Figure 13:
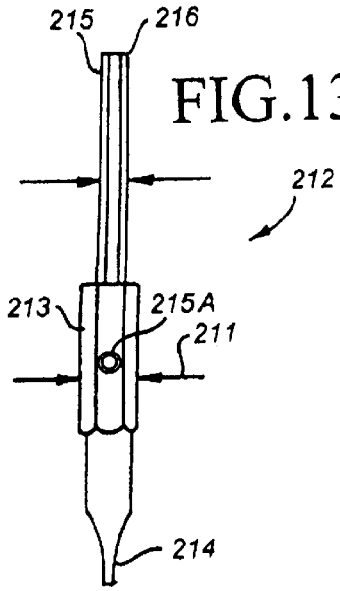
FIG. 13 is a top view illustrating a bit utilized in the tool of FIG. 11.

Bit 212 can be inverted and inserted in aperture 232A such that sni tool 215 is visible and tip 214 is inside aperture 232A. When bit 212 is inserted in aperture 232A in the direction of arrow 234, hex surface 213 contacts ledge 232D to halt the travel of bit 212 in the direction of arrow 234 such that bit 212 is seated in aperture 232A with tip 214 in the position shown in FIG. 11 (or with tip 209 in a comparable position in the event bit 212 is inverted from the position shown in FIG. 13 and is inserted in aperture 232A.

The tools or tips provided on a bit 201, 212 can be varied as desired, or additional bits can be provided. For example, in bit 201, end 202 can be a flathead screwdriver tip instead of a Phillips screwdriver tip, end 209 can be a sni tool instead of a flathead screwdriver tip, etc.

The shape and dimension of barrel 204 and/or aperture 227 can be varied as desired as long as barrel 204 can be removably inserted in aperture 227 with or without bits 201, 212 inserted in barrel 204. It is also preferable that when barrel 204 is inserted in aperture 227, barrel 204 is prohibited from rotating.

Hex surface 207 is slidably received by the hex surface formed in the end 231 such that bit 201 is prevented from rotating in aperture 232 of barrel 204 in the directions indicated by arrows 350. Hex surface 213 is slidably received by the hex surface formed in end 233 such that bit 212 is prevented from rotating in aperture 232A of barrel 204 in the directions indicated by arrows 350.

FIG. 17 illustrates a pouch 250 designed to carry to reduced telecommunication tool kit provided in accordance with the invention. It is understood that the design of the pouch 250 can vary as desired and that pouch 250 can be fabricated from any desired material. Pouch 250 includes sleeve 251 shaped and dimensioned to permit the belt of a telecommunication technician to extend through opening 253 formed therethrough. U-shaped fabric 252 enclsoes area 254 (top open, bottom closed); U-shaped fabric encloses storage area 256 (top open, bottom closed); U-shaped fabric 257 encloses storage area 258 (top open, bottom closed); U-shaped fabric 260 encloses storage area 259 (top open, bottom closed); U-shaped fabric 262 encloses open-ended (at the top and bottom of fabric 262) storage area 261; U-shaped fabric 267 encloses open-ended (at the top and bottom of fabric 267) storage area 268; U-shaped fabric 270 encloses storage area 269 (top open, bottom closed); U-shaped fabric 263 encloses storage area 264 (top open, bottom closed); and, U-shaped fabric 265 encloses storage area 266 (top open, bottom closed). Proximate end 273 of strap 271 is connected to fabric 263. Distal end 272 is preferably removably attached to fabric 265 with Velcro, a snap, etc. Strap 271 functions to secure a pair of pliers when the snout of the pliers is slipped into storage space 266.

Crimping button cartridges, zip straps, bits 201 and 212, etc. are placed in area 254. Barrel 204 is placed in area 256. Member 98A is placed in area 258. Punch down 283 is placed in area 269. Sheath knife 281 is inserted downwardly blade first in area 268. Scissors 280 are inserted in area 264. Flashlight 282 is inserted in area 259. Pliers 41A are inserted nose first in area 266 and are secured by extending end 272 strap 271 intermediate the handles and fastening end 272 to fabric 265 with Velcro or another fastener. The clip on a can of dog spray (not shown) is inserted in area 261 to secure the dog spray can to the pouch 250. The clip on the dog spray can is similar to the clip on a ball point pen.

In use, a telephone technician places the tools of FIGS. 10 and 18 into pouch 250 and mounts the pouch on his or her belt by threading an end of the belt through opening 253 and securing together around his or her waist the ends of the belt.

The technician travels to a selected telecommunication junction box.

The technician takes tool 200 and removes barrel 204 from member 98A. The technician removes bit 212 from opening 233 and utilizes sni tool 215 to unthread the bolt or bolts 290 securing one or more doors in a telecommunications junction box. If desired, the technician can invert bit 212, re-insert bit 212 in opening 232A so that sni tool 215 is visible and extends outwardly from end 233, and then use barrel 204 and the sni tool 215 in combination to loosen or unthread bolts 290. After the telecommunication box is open, the technician can slip internal hex surface 221, internal hex surface 226, the internal hex surface formed in end 233, or the internal hex surface formed in end 231 over a hex nut or hex head screw in or on the telecommunication junction box and use member 98A or barrel 204 to loosen (or tighten) the nut or screw. The technician can also utilize any of the tips 202, 209, 212 on a bit 201 or 212 (by appropriately installing a bit in barrel 204 so the desired tip can be utilized) to install or remove screws or other components from a telecommunication junction box.

The technician grasps tool 40; reaches inside the junction box with tool 40; maneuvers tool 40 to position a desired wire between members 57, 58 (this typically requires tapered members 46 and 49 to be pushed into a grouping or bundle of telephone wires, after which handles 42 and 44 are displaced in the direction of arrows C and D to slightly open jaws or members 46 and 49); displaces handles 42 and 44 in the directions of arrows A and B to squeeze and grasp the wire 15 between members 57 and 58; pulls the tool 40 to pull the wire 15 to a desired location inside or outside of the junction box 16; grasps the wire 15 with one hand and uses the other hand to cut one or more wires 15 with tool 40 by opening tool 40 by displacing handles 42 and 44 in the direction of arrows C and D, by placing the wire between cutting edges 50 and 51, and, by displacing handles 42 and 44 in the directions indicated by arrows A and B; grasps one end of the cut wire 15 and slips the end of the cut wire into an opening 104 in button 100 (or in another crimping or splicing device) so the end of the wire is positioned beneath member 102 (this is typically, but not necessarily, accomplished while holding the button 100 or end of wire 15 between members 46 and 49); opens with one hand handles 42 and 44 in the directions indicated by arrows C and D; places with another hand button 100 intermediate surfaces 52 and 53; and, displaces handles 42 and 44 in the directions indicated by arrows A and B to generate compressive forces G against member 102 which forces member 102 into aperture 105 and forces teeth 107 through the insulation in the end of the wire(s) positioned beneath member 102. Member 106 is shaped and dimensioned such that it extends over simultaneously and interconnects the ends of all three wires positioned beneath member 102 when a wire end is slid into each of the three (3) parallel cylindrical openings 104 extending into housing 105. Member 106 also interconnects the ends of any two wires slid into any two of the three openings 104. In FIG. 8, member 102 is upside down, i.e., is rotated 180 degrees from the orientation shown in FIG. 7. The method of the invention permits a telecommunications technician to find, position, cut, and splice a wire using a single tool.

The tapered configuration of members 46, 49 is important because the distal ends of members 46,49 must be able to slide into or pierce groups or bundles of wire to grasp a single wire in the bundle.

Tool 40 eliminates having to use tools 10 and 20 and, consequently, reduces the expense of equipping a telecommunications technician and reduces the time (i.e., the labor cost) associated with manipulating the telephone wires in a junction box.

Sni tools come in different sizes, but each such tool includes a detent to receive a dimple 292 that extends upwardly from the bottom of an internal hex aperture formed in a bolt 290. As used herein, a pairgain tool is considered to be a sni tool.

Having described my invention in such terms as to enable those of skill in the art to understand and practice it, and having described the presently preferred embodiments and best mode thereof, I claim:

1. A method of servicing a telecommunication box including at least one door, a nut with an external hex surface, a bolt with an internal hex surface and a dimple and mounted in the door to open and close the door, a plurality of electrical connectors, and a plurality of telecommunication wires each connected to at least one electrical connector, said method comprising the steps of (a) providing a crimping button including (i) a housing, (ii) an opening formed in the housing, (iii) a member mounted in said housing in a first operative position and displaceable to a second operative position, (iv) an electrically conductive strip attached to said member to contact, when at least one wire is inserted in said housing, said wire when said member is displaced to said second operative position;

(b) providing a first manually operated tool including a pair of components pivotally connected and each including (i) a distal end and a proximate end, (ii) a handle at the distal end operatively opposed to the handle at the distal end of the other one of said pair of components, (iii) a needle nose gripping member at the proximate end operatively opposed to the needle nose gripping member at the proximate end of the other one of said pair of components, the tool also including at least one crimp space formed therein;

(c) providing a second manually operated tool including (i) a handle including a first end and a second end, (ii) an opening formed in said first end and including an internal hex surface shaped to slide over and engage said nut, (iii) a sleeve including a first end and a second end each shaped and dimensioned to slide into said opening, said second end extending into said opening (iv) an aperture formed in said first end of said sleeve, (v) a bit including a collar shaped and dimensioned to be slidably inserted in said aperture in said first end of said sleeve and including a first side and a second side, a first sni tool end connected to and outwardly extending from said first side of said collar and shaped and dimensioned to extend into said aperture, said sni tool end extending into said aperture, and a second tool end connected to and outwardly extending from said second side of said collar and shaped and dimensioned to extend into said aperture;

(d) removing said sleeve from said opening;

(e) removing said bit from said aperture in said first end of said sleeve;

(f) utilizing said sni tool to open the door to the telecommunication box;

(g) manually manipulating said first tool to reach into the telecommunication box and grasp a portion of at least one of said telecommuncation wires with said needle nose gripping members and displace said portion to a desired location;

(h) placing said crimping button on said portion of said telecommunication wire; and (i) manually manipulating said first tool to grasp said crimping button in said crimp space of said first tool and to compress said crimping button in said crimp space to move said member from said first to said second operative position.

* * * * *